United States Patent [19]

Kirkpatrick

[11] Patent Number: 4,663,786

[45] Date of Patent: May 12, 1987

[54] DISPENSER

[76] Inventor: Lawrence E. Kirkpatrick, 3889 Nancy, Memphis, Tenn. 38118

[21] Appl. No.: 819,699

[22] Filed: Jan. 10, 1986

[51] Int. Cl.[4] ..... E03D 9/02

[52] U.S. Cl. ..... 4/222; 4/227; 4/228

[58] Field of Search ..... 4/222, 227, 228

[56] References Cited

U.S. PATENT DOCUMENTS

| | | | |
|---|---|---|---|
| 1,087,060 | 2/1914 | Gilson | 4/227 |
| 1,182,742 | 5/1916 | Bickerton | 4/227 |
| 1,866,164 | 7/1932 | Hughes et al. | 4/227 |
| 1,950,139 | 3/1934 | French | 4/227 |
| 2,207,363 | 7/1940 | Vipond | 4/227 |
| 2,644,167 | 7/1953 | Gordon | 4/227 |
| 3,080,571 | 3/1963 | Valerioti et al. | 4/228 |

*Primary Examiner*—Henry K. Artis

*Attorney, Agent, or Firm*—Berman, Aisenberg & Platt

[57] ABSTRACT

A dispensing apparatus is disclosed wherein a container has an opening therein surrounded by a rim. An actuating arm has upper and lower seals attached to one end for engaging upper and lower edges of the rim. When the lower seal engages the lower edge of the rim, a chamber is formed which fills with the liquid to be dispensed. When the actuating arms moves such that lower seal moves away from the lower edge of the rim, the substance in the chamber drains out and the upper seal engages the upper edge of the rim to prevent further dispensing of the substance.

8 Claims, 4 Drawing Figures

DISPENSER

TECHNICAL FIELD

This invention relates to the art of dispensers, particularly those used for dispensing measured amounts of a substance.

BACKGROUND ART

It is often necessary to dispense measured quantities of a first substance into another substance. For example, it may be desired to dispense a measured quantity of a disinfectant into the tank of a household toilet for sanitary purposes.

Several devices are known for dispensing measured quantities of a substance. U.S. Pat. No. 1,021,500 (Bensinger) shows a storage tank which opens into a tubular member. A float is connected to a ball value so that when a commode is flushed the float assumes a position whereby a valve chamber fills with liquid disinfectant. As the tank fills, the float rises and the disinfectant flows from the valve chamber into the tank. U.S. Pat. Nos. 1,227,997 and 2,888,685 (Clifford and Giangrasso et al) show a dispenser for antiseptic wherein a reservoir is mounted to a pivotable arm. When the water level decreases, the dispenser tilts to dispense a small quantity of antiseptic solution. U.S. Pat. No. 3,890,657 shows a dispenser wherein a chamber is filled with disinfectant as a piston moves downwardly. When the piston moves upwardly, disinfectant is pumped from the chamber into a tank. U.S. Pat. No. 3,999,226 (Wolf) shows a bellows operated by a float. When the level of water in a tank decreases, the bellows which is attached to the float is expanded drawing in disinfectant fluid. As the tank refills, the float is raised and the bellows pumps liquid into an overflow pipe and into the liquid. U.S. Pat. No. 4,312,082 (Murphy et al.) teaches a dispenser where a dispensing valve is surrounded by a cup-shaped float which is connected to the float.

SUMMARY OF INVENTION

In accordance with the invention, a unique device for dispensing measured quantities of the liquid is employed. A container of the liquid includes an opening surrounded by a rim. The volume formed by the rim is substantially equal to the desired measured quantity. An actuating arm is attached to two seals which alternately engage upper and lower edges of the rim. In the preferred embodiment, when the lower seal engages the lower edge of the rim, the volume encompassed by the rim and the lower seal fills with the liquid. Then, when the actuator moves such that the lower seal is displaced from the rim, the liquid is dispensed. At the same time, the upper seal engages the upper edge of the rim to allow dispensing of only the desired quantity of liquid.

In a typical environment, it is desired to dispense a disinfectant into the tank of a household commode. The actuating arm preferably has a float attached to one end to cause the seals to move in accordance with the level of water in the tank. When the level is high, the lower seal is displaced from the lower edge of the rim while the upper seal is engaged with the upper edge. This allows the measured quantity of disinfectant, or the like, to empty from the chamber formed by the rim and drain into the tank. Then, when the commode is flushed, the water level in the tank decreases causing the float to descend and the lower seal to engage the lower edge of the rim. The upper seal is then displaced from the upper edge of the rim and the chamber again fills with disinfectant.

An object of this invention is to provide an apparatus for dispensing measured quantities of a substance.

Another object of this invention is to provide a device wherein a rim surroundng an opening forms a chamber with a lower seal and an upper seal allows dispensing substantially only the substance contained within the chamber when the lower seal is displaced.

DETAILED DESCRIPTION OF THE DRAWINGS

Figure 1:
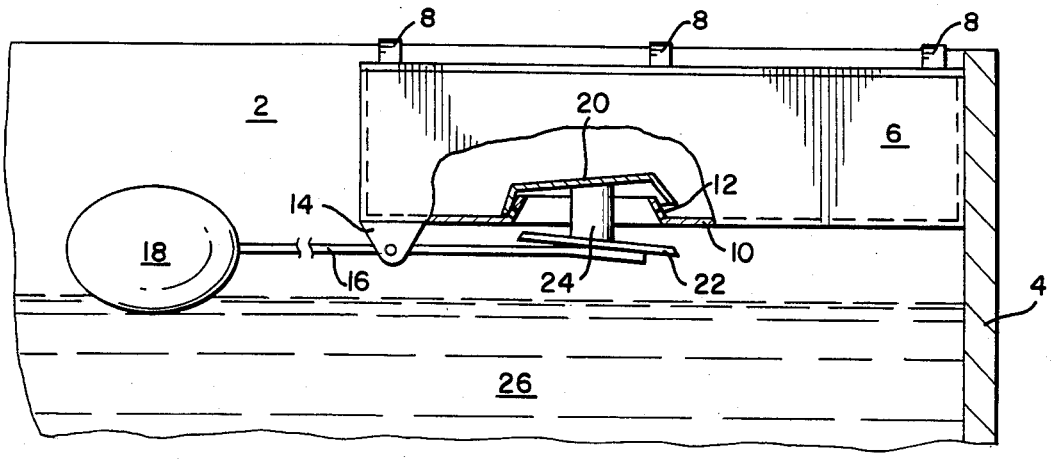
FIG. 1 is a longitudinal cross-section of a water tank showing a partially broken-away container.

FIG. 1 is a side view of a tank of a typical household commode having a back wall 2 and a side wall 4. Attached to back wall 2 is a container 6 for holding a substance to be dispensed, and container 6 may be attached to back wall 2 by hangers 8. The front of container 6 is shown broken away in the figures to show a cross-section of a bottom wall 10 of container 6. Bottom wall 10 has an opening therein surrounded by a rim 12. In the preferred embodiment, rim 12 is frustoconical, and it preferably extends toward the interior of container 6.

Attached to container 6 is a bracket 14 which pivotally mounts an arm 16. Float 18 is attached to one end of arm 16, and upper seal 20 and lower seal 22 are attached to an opposite end of arm 16. Upper and lower seals 20, 22 are connected by shaft 24.

Figure 2:
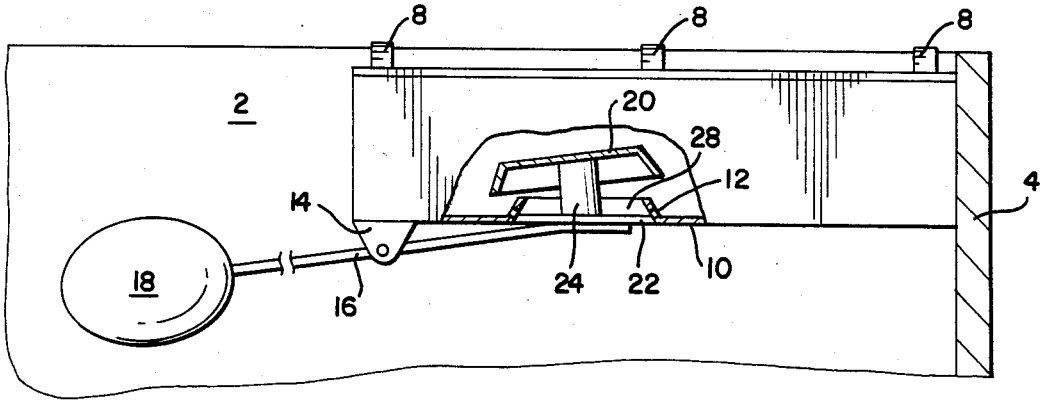
FIG. 2 is a view similar to FIG. 1 showing the apparatus wherein the tank is empty.
Figure 3:
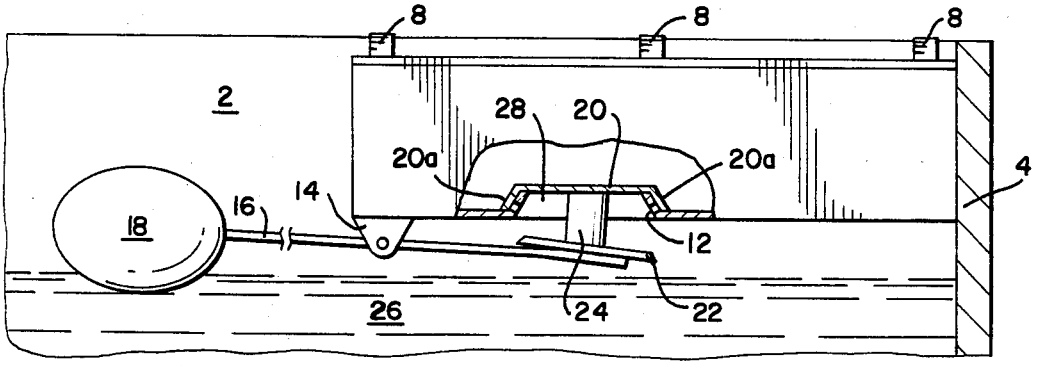
FIG. 3 is a view similar to FIG. 1 showing the apparatus wherein the tank is full.

Operation of the preferred embodiment is best described with respect to FIGS. 2 and 3.

FIG. 2 shows the situation wherein water 26 has been drained from the tank such that float 18 descends causing lower seal 22 to engage the lower portion of rim 12. Preferably, seal 22 has a conical periphery to match the interior shape of rim 12. With lower seal 22 engaged against rim 12, a chamber 28 is thereby formed. A substance in container 6 then flows into chamber 28. In the preferred embodiment, the apparatus is used for introducing a disinfectant into the tank, and container 6 is filled with this disinfectant. When water 26 fills the tank, float 18 rises a shown in FIG. 3. This causes lower seal 22 to be displaced from the lower end of rim 12 and causes upper seal 20 to engage rim 12. It will be appreciated that chamber 28 will thereby empty into the tank and become mixed with water 26. Then, if water 26 is again drained from the tank and replaced, the described process will repeat to thereby dispense another measured volume of substance from container 6 into water 26.

In the preferred embodiment, upper seal 20 includes a generally flat top part and a frustoconical side **20*a* to substantially match the shape of rim 12. As illustrated in the figures, side 20*a* of upper seal 20 is substantially equal to the height of rim 12. This unique structure allows rim 12 to be sealed more quickly on the downward stroke of arm 16 to prevent dispensing the liquid in container 6 by any significant amount greater than the volume of chamber 28**.

As shown, upper and lower seals 20, 22 are angled with respect to arm 16 to fit squarely on the edges of rim 12. Other means for accomplishing this, such as a pivotal connection could be used.

Figure 4:
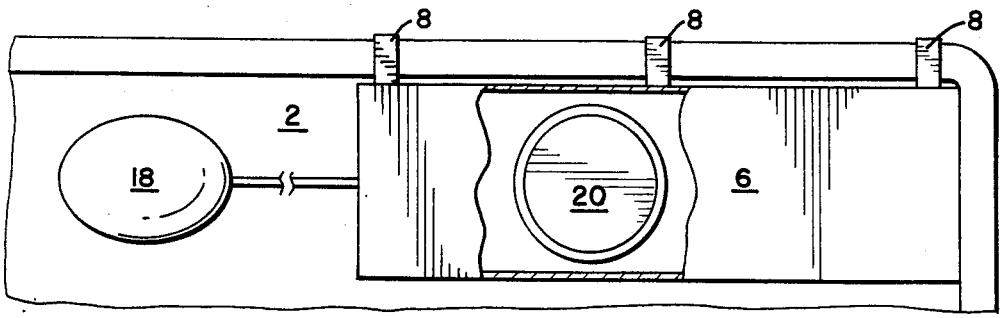
FIG. 4 is a top view of the device shown in FIG. 1.

FIG. 4 is a top view showing location of the opening and upper seal 20 and container 6.

It will be appreciated that a unique device has been described which is extremely useful for dispensing measured quantities of a liquid. By providing upper seal 20 with depending sidewall 20*a*, only a small amount of liquid will escape prior to the complete seating of the upper seal. Also, side 20*a* will prevent the escape of any substantial amount of liquid prior to full seating of lower seal 22 when water 26 has been drained.

Modifications within the scope of the appended claims will be apparent of those of skill in the art.

I claim:

1. Apparatus for dispensing a measured amount of a first substance into a second substance comprising a container for holding said first substance adjacent said second substance, said container comprising a wall with an opening therein and a rim surrounding said opening, said rim having an upper end spaced from a lower end, sealing means mounted for movement with respect to said rim, said sealing means comprising an upper sealing means for engaging said upper end of said rim and preventing flow of said first substance and a lower sealing means for engaging said lower end of said rim and preventing flow of said first substance, said upper sealing means being spaced from said lower sealing means by a distance greater than the distance between said upper end of said rim and said lower end of said rim.

2. Apparatus according to claim 1 further comprising actuating means for moving said sealing means to engage alternating said upper sealing means with said upper end of said rim and said lower sealing means with said lower end of said rim whereby said first substance flows from said container to a chamber formed by said rim and from said chamber to said second substance.

3. Apparatus according to claim 2 wherein said actuating means comprises a pivotally mounted arm having said sealing means attached to one end thereof.

4. Apparatus according to claim 3 wherein said actuating means further comprises a float means on a second end of said arm, wherein the position of said float is determined by the height of said second substance.

5. Apparatus according to claim 2 wherein said rim is conical and extends into said container.

6. Apparatus according to claim 5 wherein said upper sealing means includes a top wall and a depending side wall, said sidewall being of a shape similar to the shape of an outer surface of said rim.

7. Apparatus according to claim 2 wherein said actuating means comprises an arm and a float attached to one end of said arm, whereby the positions of said upper and lower sealing means depend upon the location said float.

8. Apparatus according to claim 7 wherein said container includes bracket means for pivotally mounting said arm.

* * * * *